US007758168B2

(12) United States Patent
Lee et al.

(10) Patent No.: US 7,758,168 B2
(45) Date of Patent: Jul. 20, 2010

(54) INKJET PRINTHEAD AND METHOD OF MANUFACTURING THE SAME

(75) Inventors: Moon-chul Lee, Yongin-si (KR); Dong-sik Shim, Yongin-si (KR); Hyung Choi, Yongin-si (KR); Yong-seop Yoon, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 601 days.

(21) Appl. No.: 11/653,371

(22) Filed: Jan. 16, 2007

(65) Prior Publication Data

US 2007/0279458 A1 Dec. 6, 2007

(30) Foreign Application Priority Data

May 30, 2006 (KR) ..... 10-2006-0049032

(51) Int. Cl.
*B41J 2/05* (2006.01)

(52) U.S. Cl. ..... 347/58; 347/61

(58) Field of Classification Search ..... 347/58, 347/61, 62

See application file for complete search history.

(56) References Cited

U.S. PATENT DOCUMENTS 6,000,787 A * 12/1999 Weber et al. ..... 347/65
6,626,523 B2 * 9/2003 Giere et al. ..... 347/65

* cited by examiner

*Primary Examiner*—An H Do
(74) *Attorney, Agent, or Firm*—Stanzione & Kim, LLP

(57) ABSTRACT

An inkjet printhead and a method of manufacturing the inkjet printhead. The inkjet printhead includes a substrate including a trench formed to a predetermined depth in an upper portion of the substrate and an ink feed hole formed through a bottom surface of the trench to supply ink, an etch stop layer formed of a metal and formed on an inner surface of the trench, a plurality of heaters, to create bubbles by heating ink, formed on the substrate, a plurality of electrodes, to apply a current to the plurality of heaters, formed on the substrate, a chamber layer stacked on the substrate and including a plurality of ink chambers formed above respective heaters to receive ink from the ink feed hole via the trench, and a nozzle layer stacked on the chamber layer and including a plurality of nozzles to eject ink from the plurality of ink chambers.

11 Claims, 9 Drawing Sheets

INKJET PRINTHEAD AND METHOD OF MANUFACTURING THE SAME

CROSS-REFERENCE TO RELATED APPLICATIONS

This application claims priority under 35 U.S.C. §119(a) of Korean Patent Application No. 10-2006-0049032, filed on May 30, 2006, in the Korean Intellectual Property Office, the disclosure of which is incorporated herein in its entirety by reference.

BACKGROUND OF THE INVENTION

1. Field of the Invention

The present general inventive concept relates to an inkjet printhead and a method of manufacturing the inkjet printhead, and more particularly, to a thermal inkjet printhead having a uniformly formed ink feed hole and a method of manufacturing the thermal inkjet printhead.

2. Description of the Related Art

Inkjet printheads are devices used to form color images on printing mediums by firing droplets of ink onto a desired region of a corresponding printing medium. Inkjet printheads can be classified into two types depending on an ink ejecting method used: thermal inkjet printheads and piezoelectric inkjet printheads. The thermal inkjet printheads generate bubbles in ink by using heat and eject the ink utilizing an expansion of the bubbles, and the piezoelectric inkjet printheads eject ink using a pressure generated by deforming a piezoelectric material.

The ink droplet ejecting mechanism of the thermal printhead will now be more fully described. When a current is applied to a heater formed of a resistive heating material, heat is generated from the heater to rapidly increase a temperature of adjoining ink to about 300° C. As a result, a bubble is created and as the bubble expands it increases a pressure of ink in an ink chamber of the thermal printhead. This pushes the ink out of an ink chamber through a nozzle in a form of a droplet.

FIG. 1 illustrates a schematic sectional view of a conventional thermal inkjet printhead. Referring to FIG. 1, the conventional inkjet printhead includes a substrate 10 on which a plurality of material layers are stacked, a chamber layer 20 disposed above the substrate 10, and a nozzle layer 30 disposed on the chamber layer 20. The chamber layer 20 includes a plurality of ink chambers 22 filled with ink that is to be ejected. The nozzle layer 30 includes a plurality of nozzles 32 to eject ink. An ink feed hole 11 is formed through the substrate 10 to supply ink to the ink chambers 22. The chamber layer 20 further includes a plurality of restrictors 24 connecting the ink chambers 22 and the ink feed hole 11.

The substrate 10 can be formed of a commonly used silicon substrate. An insulating layer 12 is formed on the substrate 10 to insulate the substrate 10 from heaters 14. The insulating layer 12 may be formed of a silicon oxide. The heaters 14 are formed on the insulating layer 12 to create bubbles by heating ink filled in the ink chambers 22. Electrodes 16 are formed on the heaters 14 to apply a current to the heaters 14. A passivation layer 18 is formed on the heaters 14 and the electrodes 16 to protect the heaters 14 and the electrodes 16. The passivation layer 18 may be formed of a silicon oxide or a silicon nitride. An Anti-cavitation layer 19 is formed on the passivation layer 18 to protect the heaters 14 from cavitation forces generated when bubbles collapse. The anti-cavitation layer 19 is usually formed of tantalum (Ta).

In the above-described inkjet printhead, however, when a rear surface of the substrate 10 is etched with a dry etching method, such as an induced coupled plasma (ICP) etching method, to form the ink feed hole 11, the substrate 10 can be overetched or underetched depending on a position of the substrate 10. In this case, the ink feed hole 10 is non-uniformly formed in the substrate 10, making ink supply to the ink chambers 22 unstable.

SUMMARY OF THE INVENTION

The present general inventive concept provides a thermal inkjet printhead having a uniformly formed ink feed hole, and a method of manufacturing the inkjet printhead.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing an inkjet printhead including a substrate including a trench formed to a predetermined depth in an upper portion of the substrate and an ink feed hole to supply ink formed through a bottom surface of the trench, an etch stop layer formed of a metal and formed on an inner surface of the trench, a plurality of heaters, to create bubbles by heating ink, formed on the substrate, a plurality of electrodes, to apply a current to the plurality of heaters, formed on the substrate, a chamber layer disposed on the substrate and including a plurality of ink chambers formed above the respective heaters to receive ink from the ink feed hole via the trench, and a nozzle layer stacked on the chamber layer and including a plurality of nozzles to eject ink from the ink chambers.

The trench may be wider than the ink feed hole.

The substrate may be formed of silicon.

The inkjet printhead may further include an insulating layer between the substrate and the plurality of heaters, and the insulating layer may be formed of a silicon oxide.

The inkjet printhead may further include a passivation layer formed on the plurality of heaters and the plurality of electrodes, and the passivation layer may be formed of a silicon nitride or a silicon oxide.

The inkjet printhead may further include a plurality of anti-cavitation layers formed on the passivation layer to protect the respective heaters, and the plurality of anti-cavitation layers may be formed of tantalum (Ta).

The foregoing and/or other aspects and utilities of the present general inventive concept may also be achieved by providing a method of manufacturing an inkjet printhead, the method including forming an insulating layer on a substrate, forming a plurality of heaters and a plurality of electrodes on the insulating layer, the electrodes to apply a current to the heaters, forming a passivation layer on the heaters and the electrodes, etching the passivation layer, the insulating layer, and an upper portion of the substrate to form a trench, forming a metallic etch stop layer on an inner surface of the trench, forming a chamber layer having a plurality of ink chambers on the passivation layer, forming a sacrificial layer to fill the trench and the ink chambers, forming a nozzle layer having a plurality of nozzles on top surfaces of the chamber layer and the sacrificial layer, etching a bottom surface of the substrate to form an ink feed hole that exposes the etch stop layer formed on a bottom surface of the trench, removing a portion of the etch stop layer exposed through the ink feed hole, and removing the sacrificial layer in the trench and the ink chambers.

The forming of the metallic etch stop layer may be performed by depositing a predetermined metal and etching the deposited metal. Alternatively, the forming of the etch stop layer may be performed using a lift-off process.

The etching a bottom rear surface of the substrate may be performed by dry etching.

The removing of the portion of the etch stop layer may be performed by dry etching or wet etching.

The method may further include forming a plurality of anti-cavitation layers on the passivation layer after the passivation layer is formed. The method may further include planarizing a top portion of the sacrificial layer after the sacrificial layer is formed.

The foregoing and/or other aspects and utilities of the present general inventive concept may also be achieved by providing a method of manufacturing an inkjet printhead, including forming a trench to a predetermined depth in an upper portion of a substrate and forming an ink feed hole to supply ink in a bottom surface of the trench, forming an etch stop layer formed of a metal on a surface of the trench, forming a plurality of heaters on the substrate to create bubbles by heating the ink, forming a plurality of electrodes on the substrate to apply a current to the heaters, forming a chamber layer having a plurality of ink chambers on the substrate to receive ink from the ink feed hole via the trench, and stacking a nozzle layer having a plurality of nozzles on the chamber layer to eject the ink from the ink chambers.

The foregoing and/or other aspects and utilities of the present general inventive concept may also be achieved by providing a method of manufacturing a thermal inkjet printhead, including forming a heaters and electrodes on a substrate, forming a trench in the substrate, forming an etch stop layer on the trench, forming ink chambers, nozzles, and restrictors to correspond with the heaters and electrodes, and etching a bottom surface of the substrate to form in ink supply hole which is smaller in width than a width of the trench.

The foregoing and/or other aspects and utilities of the present general inventive concept may also be achieved by providing a thermal inkjet printhead including a substrate including a trench and an ink supply hole, an etch stop layer formed on the trench, a plurality of heaters disposed above the substrate, a plurality of electrodes disposed above the substrate, an ink chamber layer disposed above the substrate and including a plurality of ink chambers and a plurality of restrictors to receive ink through the trench and the ink supply hole, and a nozzle layer above the chamber layer including a plurality of nozzles to eject ink from the ink chamber.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
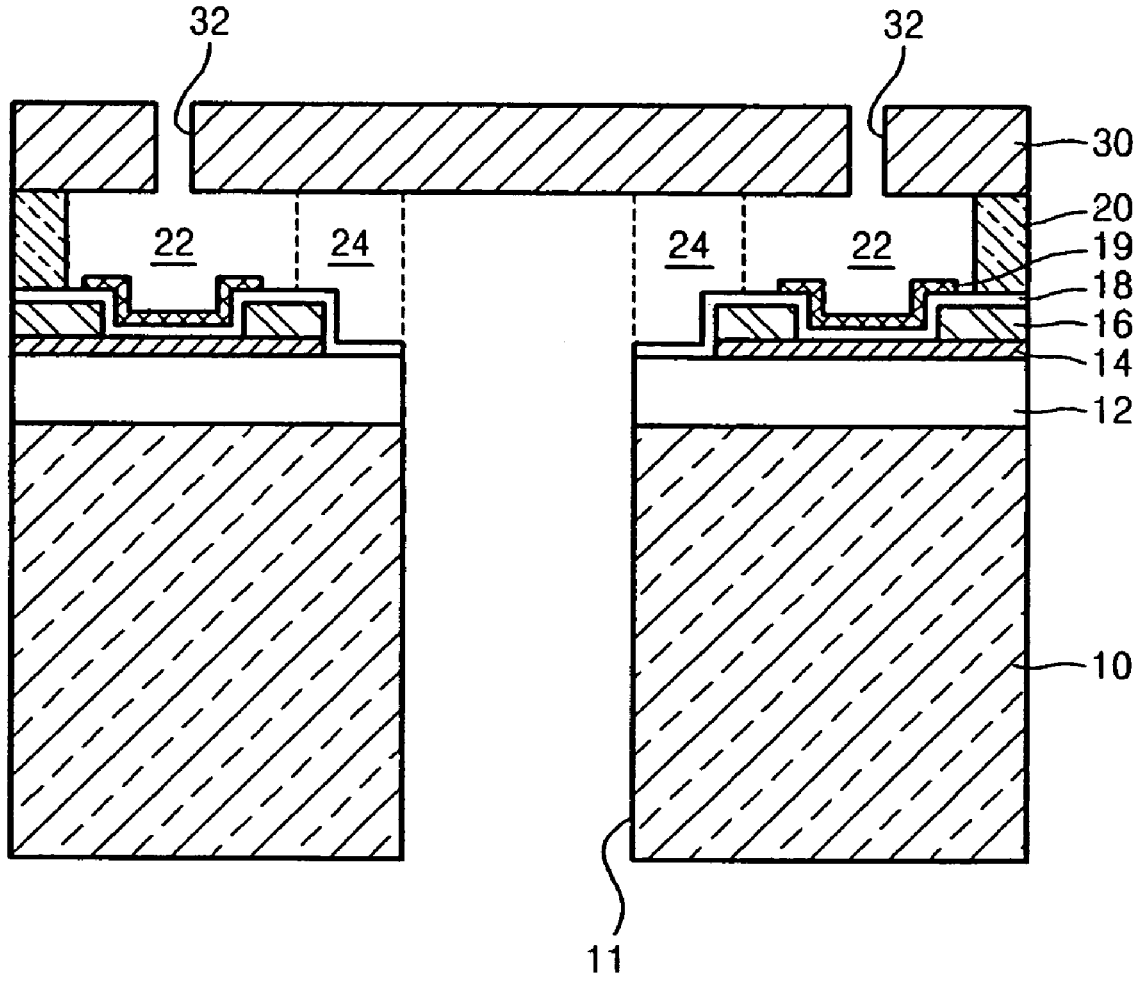
FIG. 1 (PRIOR ART)
FIG. 1 is a schematic sectional view illustrating a conventional inkjet printhead.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
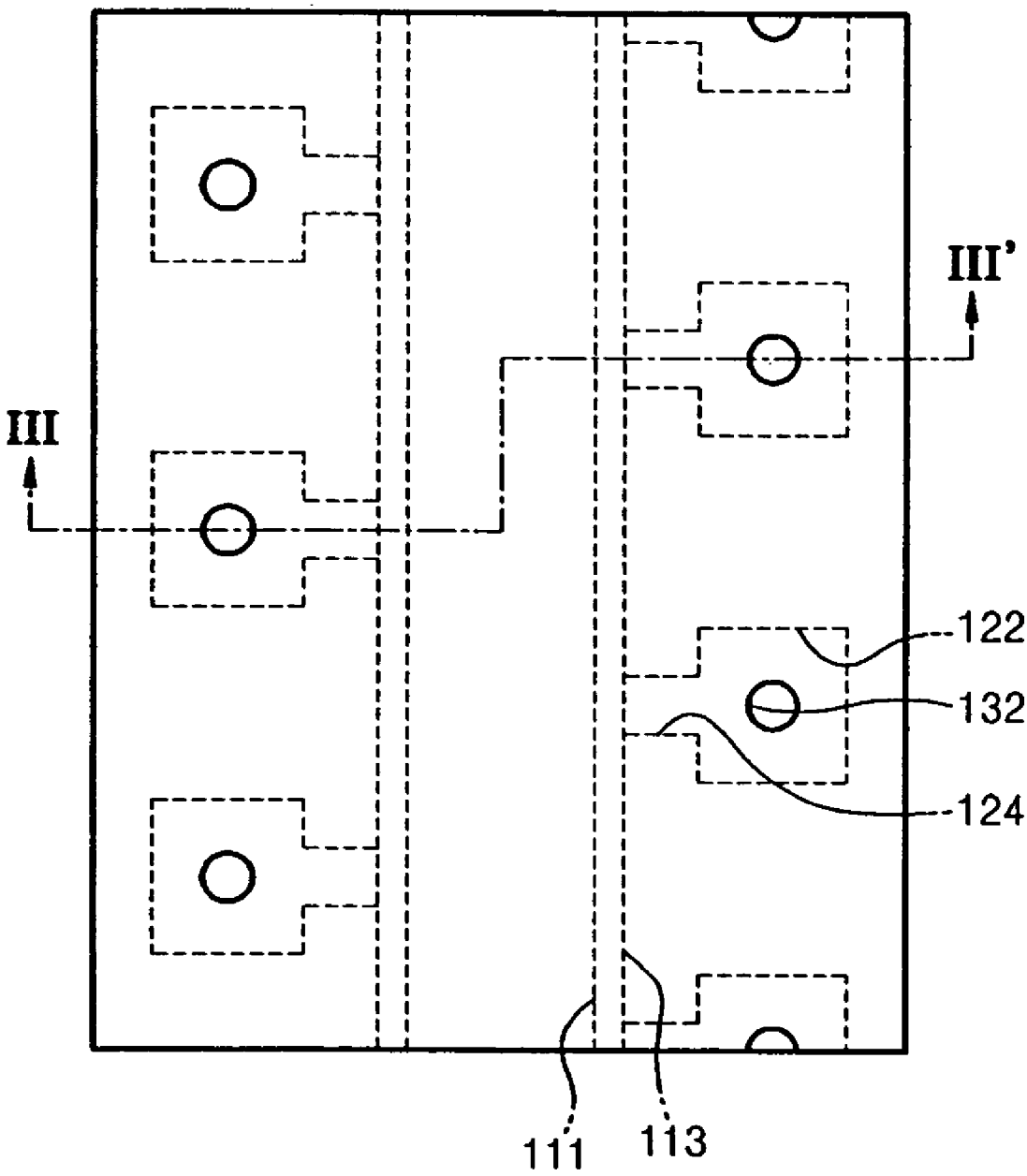
FIG. 2 is a schematic plan view illustrating an inkjet printhead according to an embodiment of the present general inventive concept.
Figure 3:
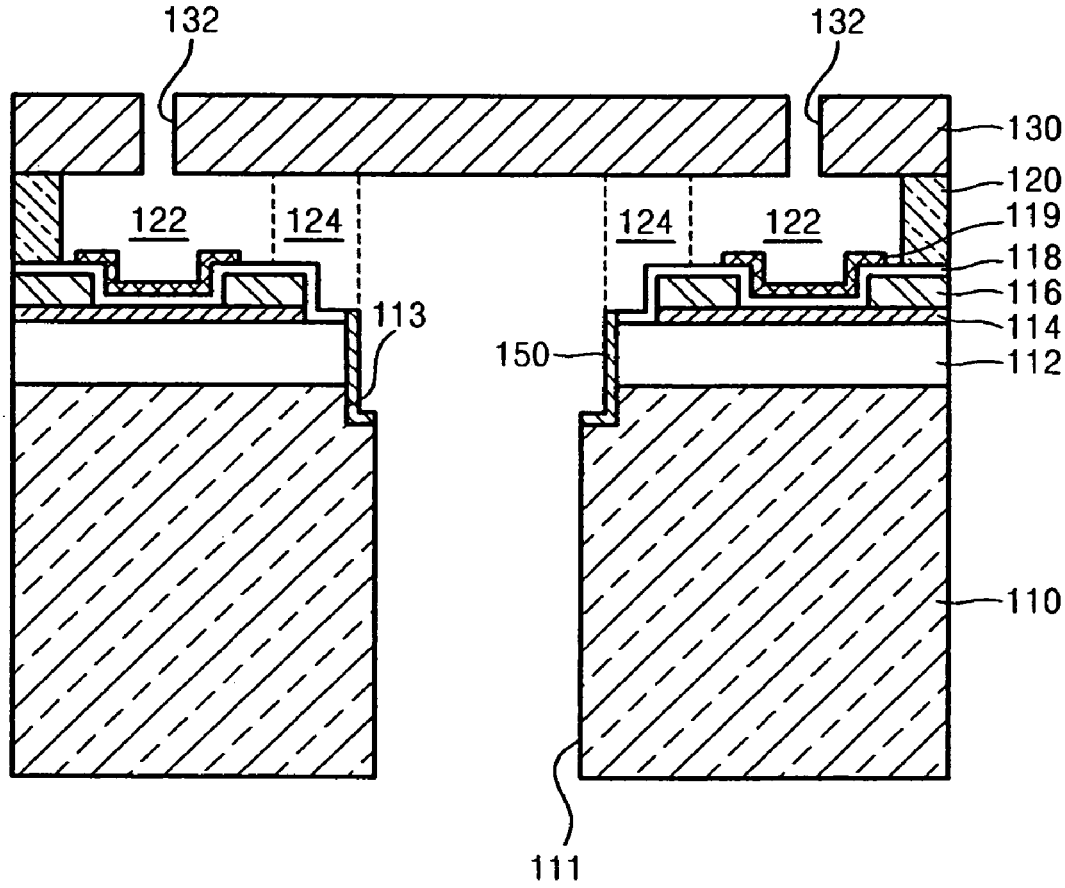
FIG. 3 is a sectional view illustrating the inkjet printhead of FIG. 2 taken along line III-III' of FIG. 2.

FIG. 2 is a schematic plan view illustrating an inkjet printhead according to an embodiment of the present general inventive concept, and FIG. 3 is a sectional view illustrating the inkjet printhead of FIG. 2 taken along line III-III' of FIG. 2.

Referring to FIGS. 2 and 3, the inkjet printhead includes a substrate 110, a plurality of heaters 114 and a plurality of electrodes 116 formed on the substrate 110, a chamber layer 120 formed above the substrate 110, and a nozzle layer 130 formed on the chamber layer 120. The chamber layer 120 includes a plurality of ink chambers 122 and a plurality of restrictors 124. The nozzle layer 130 includes a plurality of nozzles 132. Although the nozzles 132 are arranged in two rows, as illustrated in FIG. 2, the present general inventive concept is not limited to the illustrated nozzle arrangement. For example, the nozzles 132 can be arranged in one row or three or more rows.

The substrate 110 can be formed of a commonly used silicon substrate. An insulating layer 112 can be formed on the substrate 110 to thermally and electrically insulate the substrate 110 and the heaters 114 from each other. The insulating layer 112 may be formed of a silicon oxide. The heaters 114 are formed on the insulating layer 112 to create bubbles by heating ink filled in the ink chambers 122. The heaters 114 may be formed of a resistive heating material such as a tantalum-aluminum alloy, a tantalum nitride, a titanium nitride, or a tungsten silicide. A plurality of electrodes 116 are formed on each of the heaters 114 to apply a current to each of the heaters 114. The electrodes 116 are formed of a material having a high electrical conductivity. For example, the electrodes 116 may be formed of aluminum (Al), an aluminum alloy, gold (Au), or silver (Ag).

Further, a passivation layer 118 can be formed on the heaters 114 and the electrodes 116. The passivation layer 118 prevents the heaters 114 and the electrodes 116 from oxidizing or corroding by contacting ink. The passivation layer 118 may be formed of a silicon oxide or a silicon nitride. A plurality of anti-cavitation layers 119 can be formed above a bottom surface of the ink chambers 122. That is, the anti-cavitation layers 119 can be formed on the passivation layer 118 above the heaters 114 and the electrodes 116. The anti-cavitation layers 119 protect the heaters 114 from cavitation forces generated when ink bubbles collapse. The anti-cavitation layers 119 may be formed of tantalum (Ta).

The chamber layer 120 is formed on the passivation layer 118. The ink cambers 122 of the ink chamber layer 120 receive ink, and the restrictors 124 of the ink chamber layer 120 allow ink to be supplied from an ink feed hole 111 (described later) to the respective ink chambers 122. The ink chambers 122 are located above the heaters 114, respectively. The chamber layer 120 may be formed of polymer or the like. The nozzle layer 130 is formed on the chamber layer 120. The ink filled in the ink chambers 122 is ejected through the nozzles 132 of the nozzle layer 130. The nozzles 132 are located above their respective ink chambers 122. The nozzle layer 130 may be formed of polymer or the like.

Meanwhile, a trench 113 is formed to a predetermined depth in a top portion of the substrate 110. The trench 113 is located above the ink feed hole 111 and is connected to the restrictors 124. The trench 113 may be wider than the ink feed hole 111. The passivation layer 118, the insulating layer 112, and a top portion of the substrate 110 may be sequentially etched to form the trench 113. An etch stop layer 150 is formed on an inner surface of the trench 113. The etch stop layer 150 may be formed of a metal. The ink feed hole 111 is formed in the substrate 110 and is connected to the trench 113 to supply ink to the ink chambers 122. The ink feed hole 111 penetrates a bottom surface of the trench 113. Therefore, ink can be supplied from the ink feed hole 111 to respective ink chambers 122 through the trench 113 and the restrictors 124. The trench 113 is formed in a direction in which the nozzles 132 are arranged, between the ink feed hole 111 and the restrictors 124. The trench 113 is recessed from the ink feed hole and extended in a direction of an ink supplying direction of the ink feed hole 111 to a bottom of the restrictors 124.

In the current embodiment of the present general inventive concept, as explained above, the trench 113 is formed in the top portion of the substrate 110. The trench 113 is connected to the ink feed hole 111 and has a larger width than the ink feed hole 111. Further, the etch stop layer 150 is formed of a metal on the inner surface of the trench, particularly, on the bottom surface of the trench 113. Therefore, the ink feed hole 111 can be uniformly formed (described later in detail), so that ink can be uniformly supplied from the ink feed hole 111 to the respective ink chambers 122.

A method of manufacturing an inkjet printhead will now be described according to an embodiment of the present general inventive concept. FIGS. 4 through 13 are views illustrating a method of manufacturing an inkjet printhead according to an embodiment of the present general inventive concept.

Figure 4:
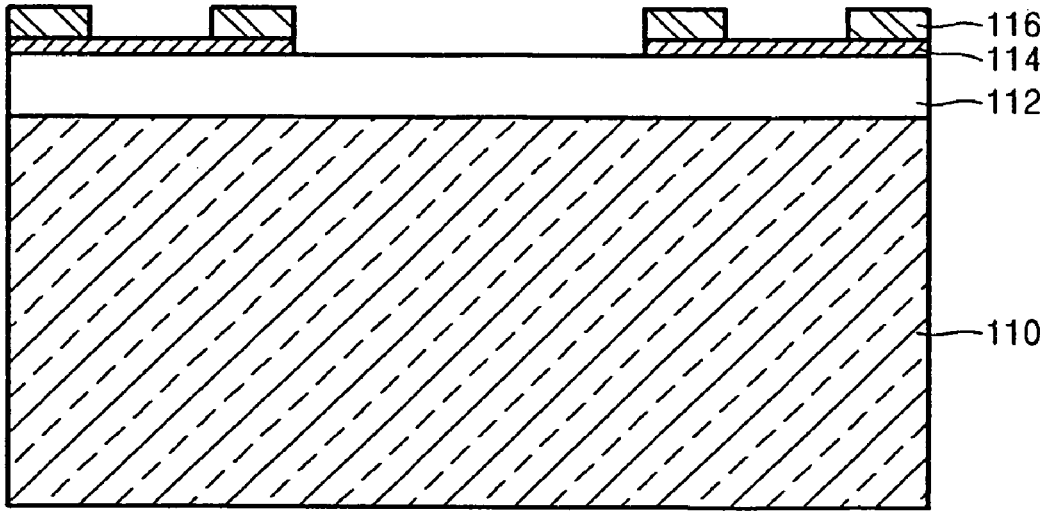
FIGS. 4 through 13 are views illustrating a method of manufacturing an inkjet printhead according to an embodiment of the present general inventive concept.

Referring to FIG. 4, a substrate 110 is prepared. Generally, a silicon substrate can be used for the substrate 110. An insulating layer 112 is formed on the substrate 110 to a predetermined thickness. The insulating layer 112 is formed to thermally and electrically insulate the substrate 110 and heaters (described later) from each other. The insulating layer 112 may be formed of a silicon oxide. A plurality of heaters 114 are formed on the insulating layer 112 to generate bubbles by heating ink. A resistive heating material, such as a tantalum-aluminum alloy, a tantalum nitride, a titanium nitride, or a tungsten silicide, may be deposited on the insulating layer 112, and the deposited resistive heating material may be patterned to form the heaters 114. Electrodes 116 are formed on each of the heaters 114 to apply a current to the heaters 114. A metal having a high electric conductivity, such as aluminum (Al), aluminum alloy, gold (Au), and silver (Ag), may be deposited on the heaters 114, and the deposited material may be patterned to form the electrodes 116.

Figure 5:
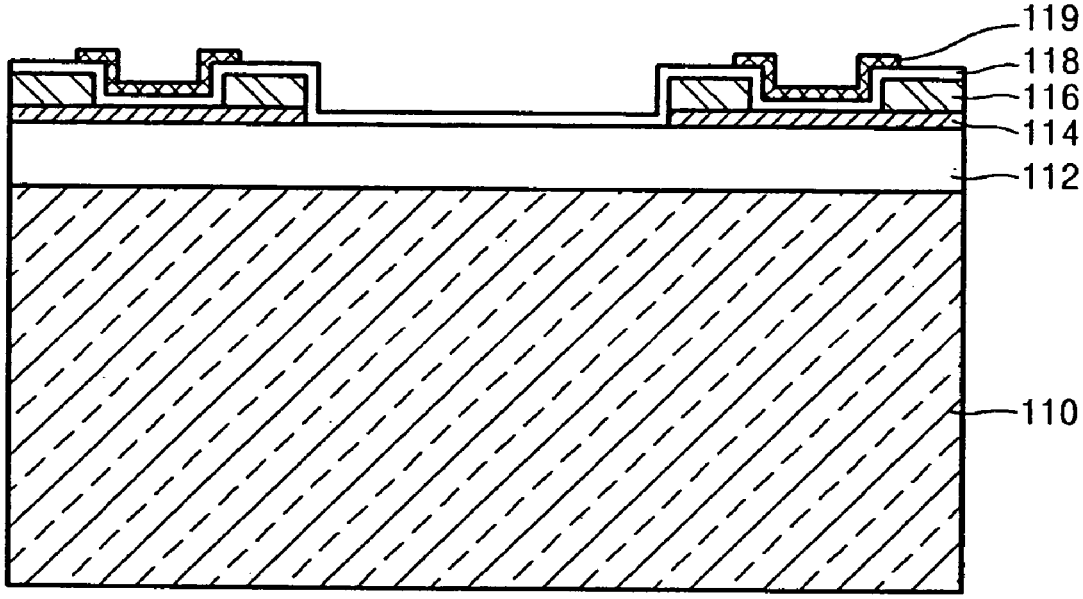

Referring to FIG. 5, a passivation layer 118 is formed on the insulating layer 112 to cover the heaters 114 and the electrodes 116. The passivation layer 118 prevents the heaters 114 and the electrodes 116 from making contact with the ink, to thereby protect the heaters 114 and the electrodes against oxidization or corrosion. The passivation layer 118 may be formed of a silicon oxide or a nitride oxide. Anti-cavitation layers 119 are formed above bottom surfaces of ink chambers (refer to reference numeral 122 in FIG. 3) to be formed later. That is, the anti-cavitation layers 119 are formed on the passivation layer 118 above respective heaters 114. For example, tantalum (Ta) may be deposited on the passivation layer 118 and then the deposited tantalum (Ta) may be patterned to form the anti-cavitation layers 119.

Figure 6:
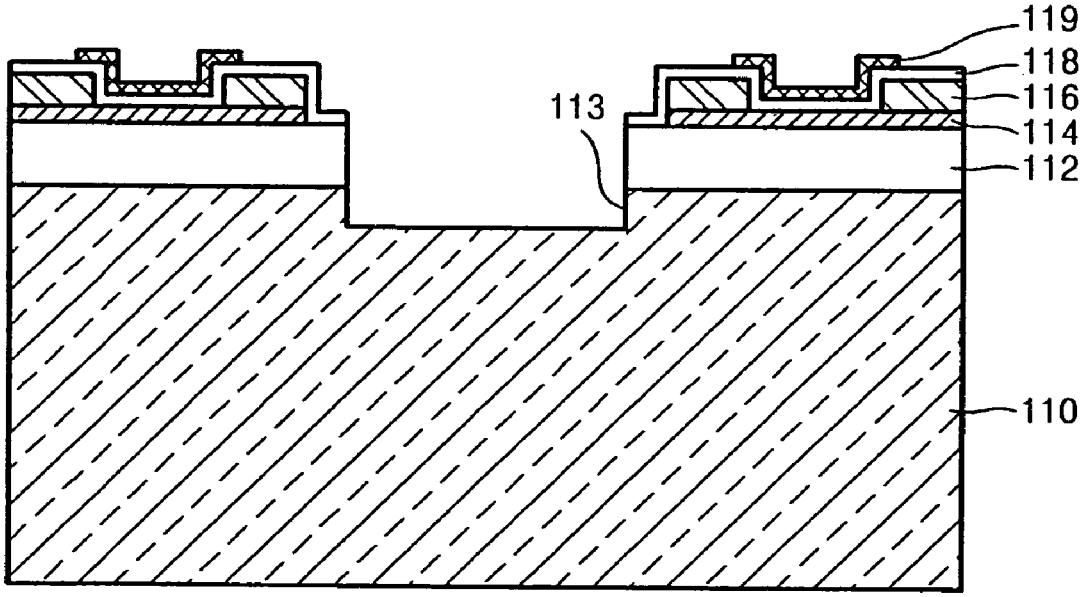

Referring to FIG. 6, the passivation layer 118, the insulating layer 112, and an upper portion of the substrate 110 are sequentially etched to form a trench 113 of a predetermined depth. Here, the trench 113 is located to correspond to an ink feed hole (refer to reference numeral 111 in FIG. 3) to be formed later. The trench 113 may be wider than the ink feed hole.

Figure 7:
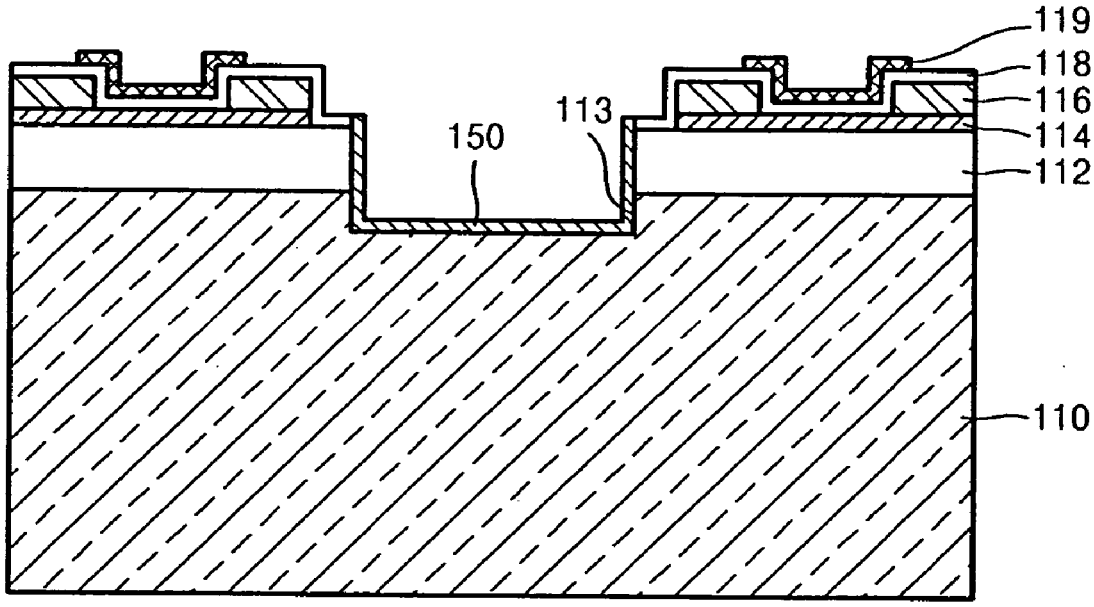

Referring to FIG. 7, a metallic etch stop layer 150 is formed on an inner surface of the trench 113. The etch stop layer 150 allows uniform formation of the ink feed hole. The etch stop layer 150 can be formed of a predetermined metal and can be formed by depositing and etching. Specifically, a predetermined metal can be deposited on an entire surface of the resultant structure shown in FIG. 6, and then the deposited metal can be etched so that only the deposited material on the inner surface of the trench 113 remains. Alternatively, the etch stop layer 150 can be formed using a lift-off process.

Figure 8:
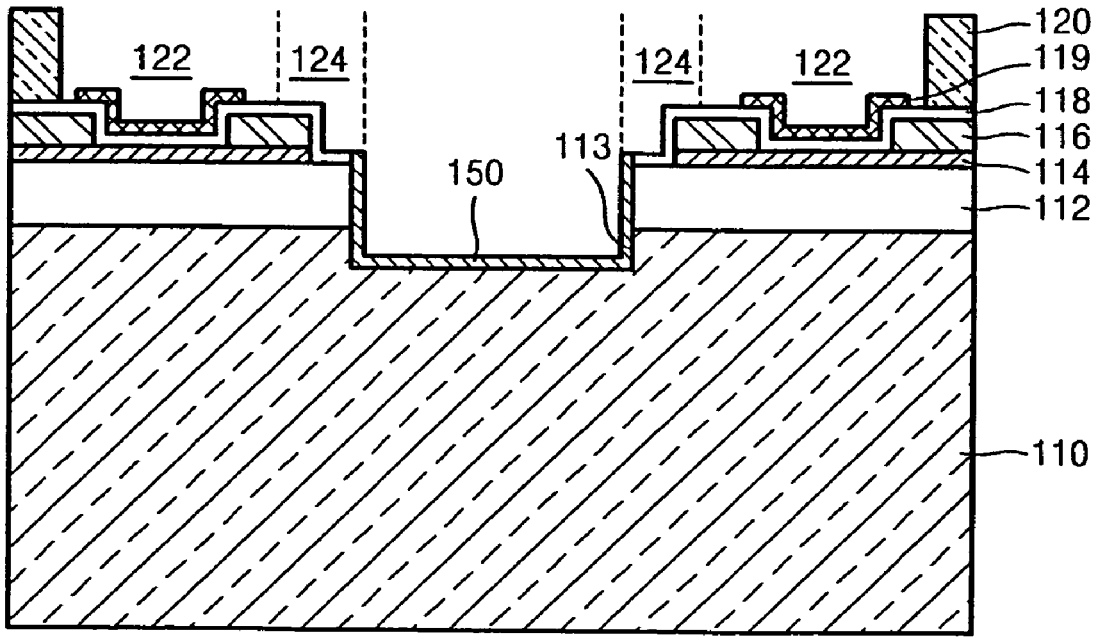

Referring to FIG. 8, a chamber layer 120 is formed on the passivation layer 118. A predetermined material such as polymer may be formed to a predetermined thickness on an entire surface of the resultant structure shown in FIG. 7, and then the material may be patterned to form the chamber layer 120. In this way, a plurality of ink chambers 122 and a plurality of restrictors 124 are formed in the chamber layer 120. The ink chambers 122 receive ink to be ejected, and the restrictors 124 are passages that allow ink to flow into the ink chambers 122. The ink chambers 122 are located above respective heaters 114, and the restrictors 124 are connected to the trench 113.

Figure 9:
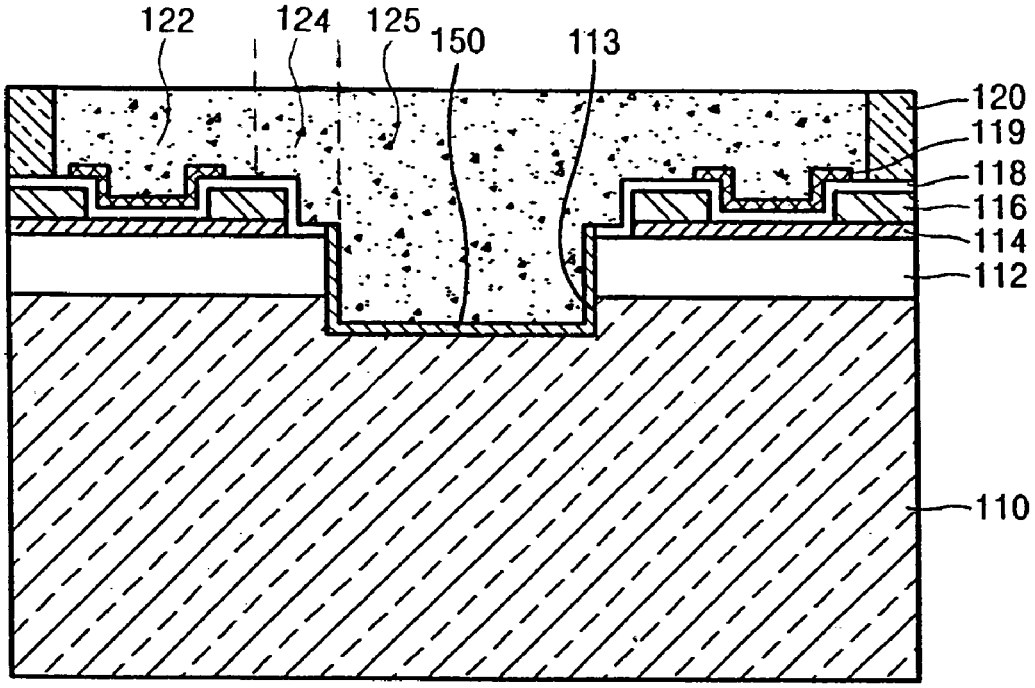

Referring to FIG. 9, a sacrificial layer 125 is filled in the trench 113, the restrictors 124, and the ink chambers 122. A planarization can be additionally performed to planarize a top of the sacrificial layer 125. For example, chemical mechanical polishing (CMP) can be performed to planarize the top of the sacrificial layer 125.

Figure 10:
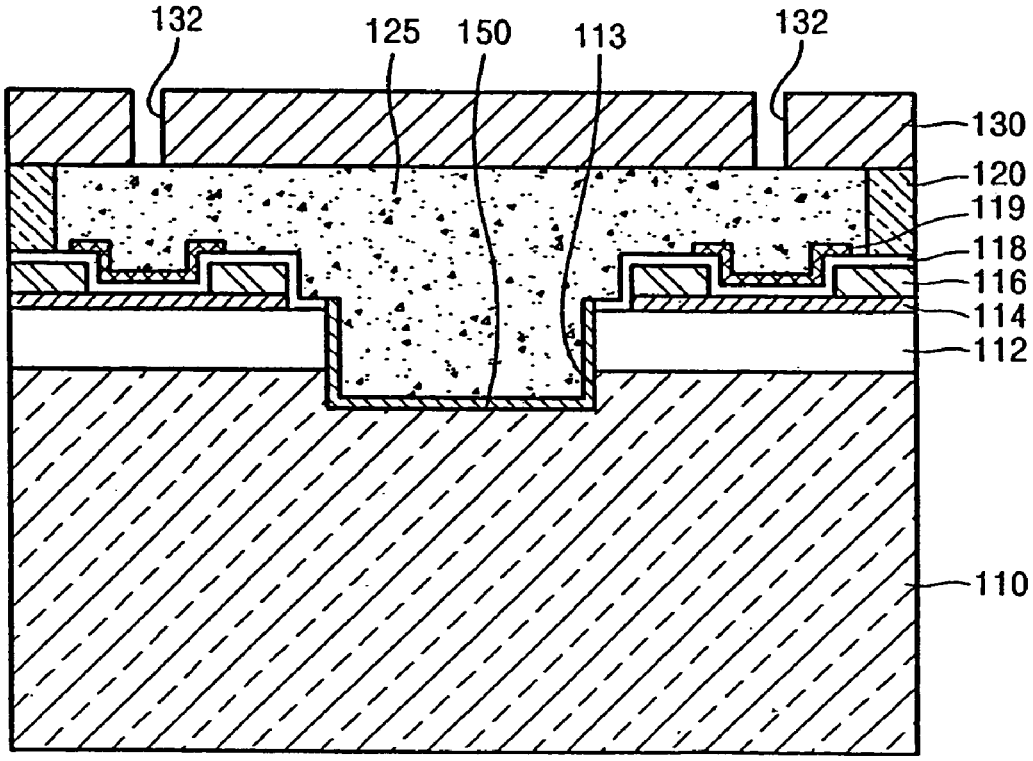

Referring to FIG. 10, a nozzle layer 130 is formed on top surfaces of the sacrificial layer 125 and the chamber layer 120. For example, polymer can be formed to a predetermined thickness on top surfaces of the sacrificial layer 125 and the chamber layer 120, and then the polymer can be patterned to form the nozzle layer 130. In this way, a plurality of nozzles 132 are formed in the nozzle layer 130 to eject ink. Here, the nozzles 132 are located above respective ink chambers 122 and the nozzles 132 expose the sacrificial layer 125.

Figure 11:
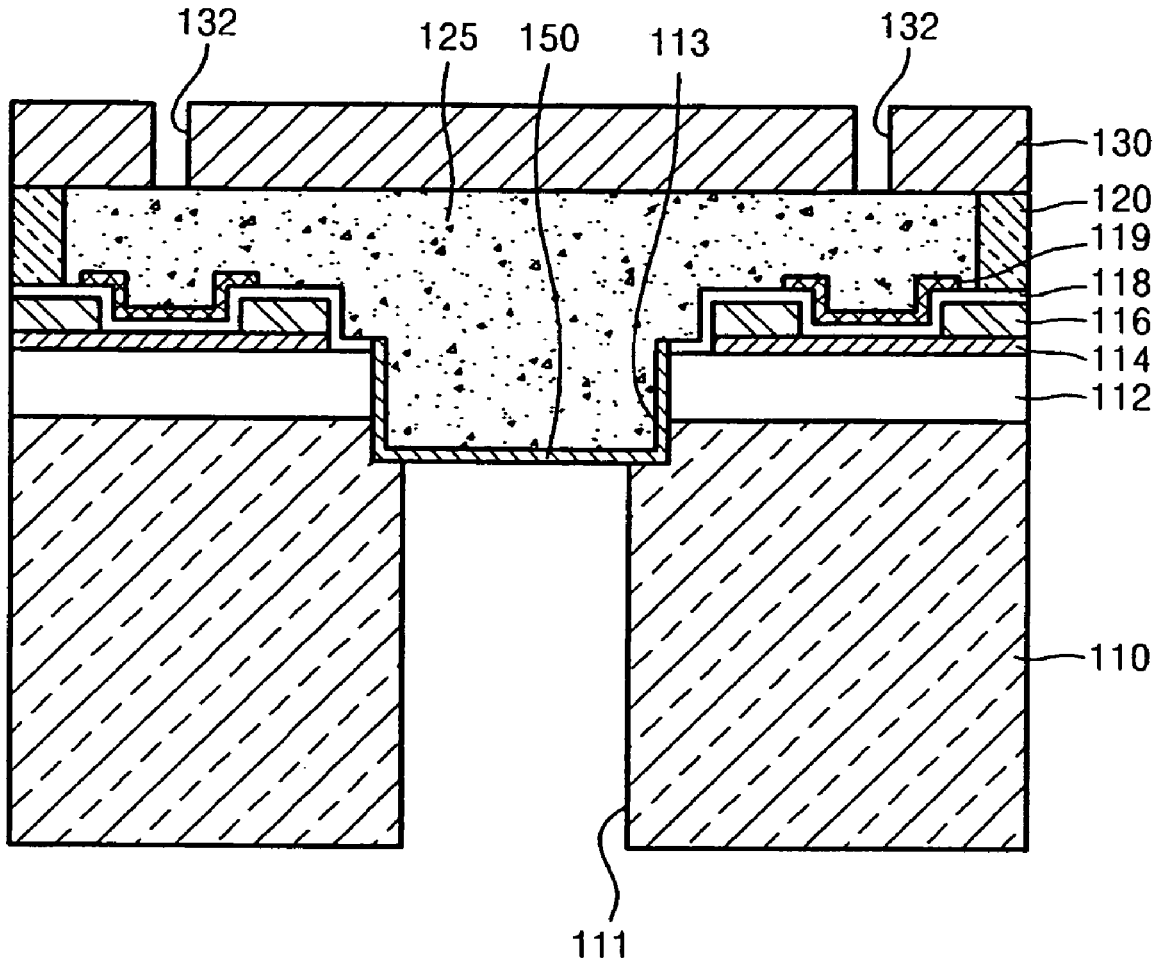

Referring to FIG. 11, a bottom surface of the substrate 110 is etched to form an ink feed hole 111 to supply ink. The ink feed hole 111 may be formed by dry etching a bottom surface of the substrate 110 until the metallic etch stop layer 150 formed on a bottom of the trench 113 is exposed. Here, as described above, the ink feed hole 111 is narrower than the trench 113. The trench 113 is formed in a top portion of the substrate 110 and is wider than the ink feed hole 111, and the metallic etch stop layer 150 is formed on an inner surface (particularly, the bottom surface) of the trench 113, so that the ink feed hole 111 can be uniformly formed. That is, when a rear surface of the substrate 110 is dry etched until the etch stop layer 150 formed on the bottom surface of the trench 113 is exposed, the ink feed hole 111 can be uniformly formed without a notch.

Figure 12:
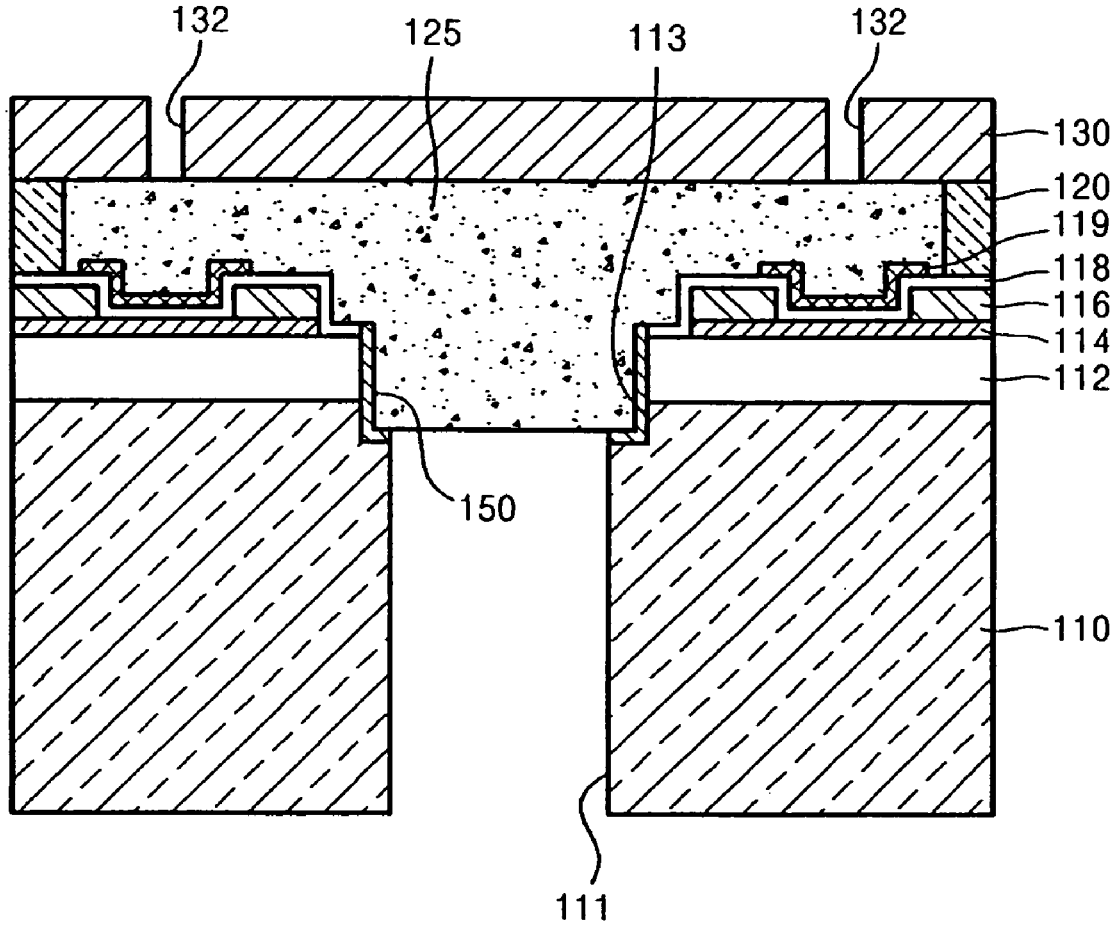

Referring to FIG. 12, a portion of the etch stop layer 150 exposed by the ink feed hole 111 is removed. Here, the exposed portion of the metallic etch stop layer 150 formed on the bottom surface of the trench 113 can be removed by dry etching or wet etching.

Figure 13:
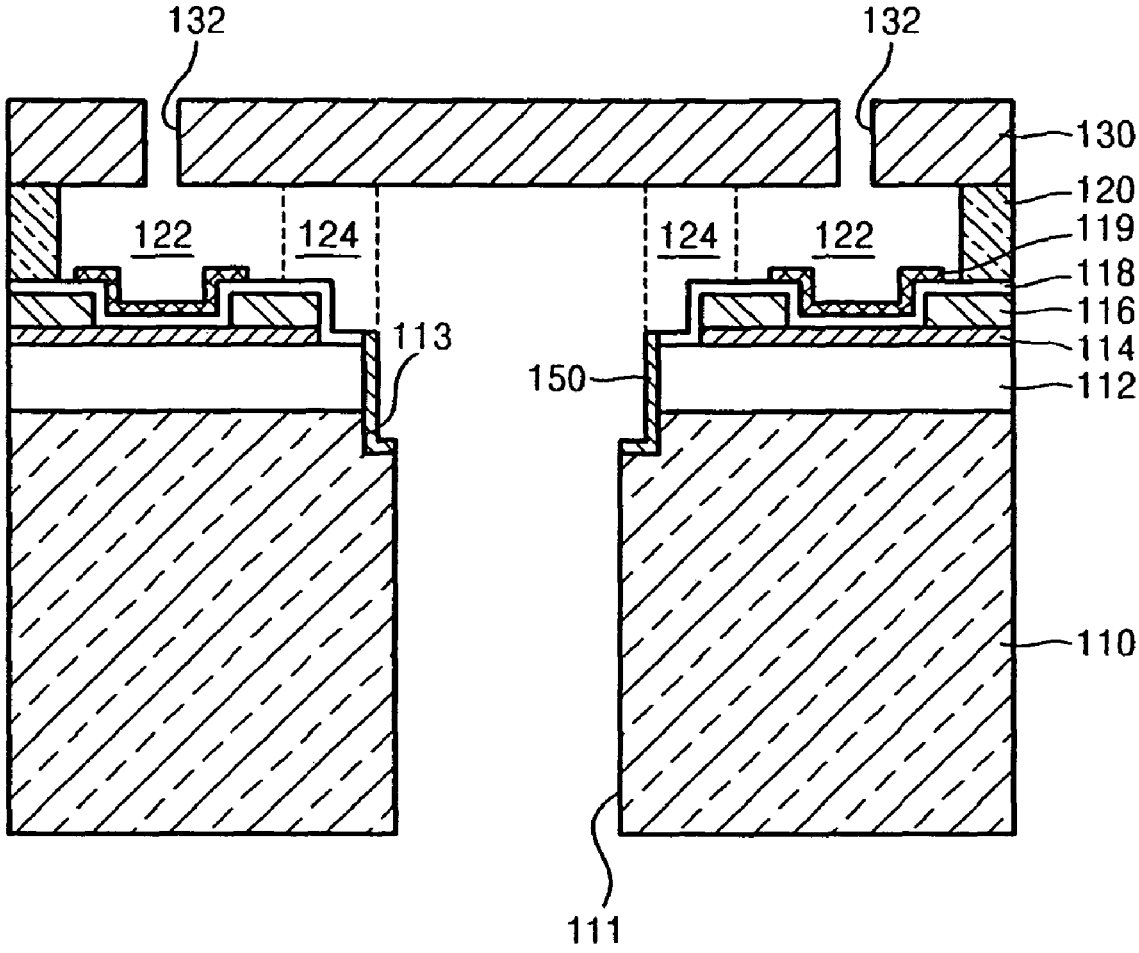

Referring to FIG. 13, the sacrificial layer 125 fills in the ink chambers 122 and the restrictors 124, and the trench 113 is removed. In this way, manufacture of an inkjet printhead is completed according to an embodiment of the present general inventive concept. Here, the sacrificial layer 125 can be removed by injection of a predetermined etchant through the nozzles 132 and the ink feed hole 111.

It will also be understood that when a layer is referred to as being "on" another layer or substrate, it can be directly on the other layer or substrate, or intervening layers may also be present. Each element of the inkjet printhead can be formed of a different material from the illustrated one. Furthermore, each element of the inkjet printhead can be formed using a stacking or forming method different from the illustrated one. In the method of forming the inkjet printhead according to the present general inventive concept, operations of the method can be performed in a different order from the illustrated order.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inkjet printhead comprising:

a substrate including a trench formed to a predetermined depth in an upper portion of the substrate and an ink feed hole to supply ink formed through a bottom surface of the trench;

an etch stop layer formed of a metal and formed on a surface of the trench;

a plurality of heaters, formed on the substrate to create bubbles by heating ink;

a plurality of electrodes, formed on the substrate to apply a current to the heaters;

a chamber layer disposed on the substrate and including a plurality of ink chambers formed above the respective heaters to receive ink from the ink feed hole via the trench; and a nozzle layer stacked on the chamber layer and including a plurality of nozzles to eject ink from the ink chambers.

2. The inkjet printhead of claim 1, wherein the trench is wider than the ink feed hole.

3. The inkjet printhead of claim 1, wherein the substrate is formed of silicon.

4. The inkjet printhead of claim 1, further comprising:

an insulating layer formed between the substrate and the heaters.

5. The inkjet printhead of claim 4, wherein the insulating layer is formed of a silicon oxide.

6. The inkjet printhead of claim 4, further comprising:

a passivation layer formed on the heaters and the electrodes.

7. The inkjet printhead of claim 6, wherein the passivation layer is formed of a silicon nitride or a silicon oxide.

8. The inkjet printhead of claim 6, further comprising:

a plurality of anti-cavitation layers formed on the passivation layer to protect respective heaters.

9. The inkjet printhead of claim 8, wherein the anti-cavitation layers are formed of tantalum (Ta).

10. A thermal inkjet printhead comprising:

a substrate including a trench and an ink supply hole;

an etch stop layer formed on the trench;

a plurality of heaters disposed above the substrate;

a plurality of electrodes disposed above the substrate;

an ink chamber layer disposed above the substrate and including a plurality of ink chambers and a plurality of restrictors to receive ink through the trench and the ink supply hole; and a nozzle layer above the chamber layer including a plurality of nozzles to eject ink from the ink chambers, wherein the etch stop layer is metallic and is formed on an inner surface of the trench at a predetermined depth in an upper portion of the substrate.

11. The thermal inkjet printhead of claim 10, wherein the ink supply hole in the substrate is narrower than a width of the trench and is formed by dry etching the substrate.

* * * * *